US005253824A

United States Patent [19]

Halila et al.

[11] Patent Number: 5,253,824

[45] Date of Patent: Oct. 19, 1993

[54] HOLLOW CORE AIRFOIL

[75] Inventors: Herbert Halila; Kurt L. Hansen, both of Cincinnati, Ohio

[73] Assignee: General Electric Company, Cincinnati, Ohio

[21] Appl. No.: 939,531

[22] Filed: Sep. 1, 1992

Related U.S. Application Data

[63] Continuation of Ser. No. 685,946, Apr. 16, 1991, abandoned.

[51] Int. Cl.[5] ..... B64C 3/18; B64C 11/24

[52] U.S. Cl. ..... 244/123; 416/233

[58] Field of Search ..... 244/123, 35 R; 416/232, 416/233, 229 A, 241 A, 241 B

[56] References Cited

U.S. PATENT DOCUMENTS

| | | | |
|---|---|---|---|
| 1,246,891 | 11/1917 | Diggle | 416/233 |
| 1,922,179 | 8/1933 | Squires | 416/233 |
| 2,004,102 | 6/1935 | Dickey | 416/233 |
| 2,262,606 | 11/1941 | Hardman | 244/123 |
| 2,410,609 | 11/1946 | Pecker | 244/123 |
| 2,806,663 | 9/1957 | Rosenblatt | 244/123 |
| 3,560,107 | 2/1971 | Helms | 416/229 |
| 4,203,204 | 5/1980 | Murphy | 29/431 |
| 4,863,117 | 9/1989 | Riout | 244/46 |

FOREIGN PATENT DOCUMENTS

| | | | |
|---|---|---|---|
| 234975 | 2/1960 | Australia | 416/233 |
| 266954 | 5/1988 | European Pat. Off. . | |
| 251659 | 6/1926 | United Kingdom . | |
| 269260 | 4/1927 | United Kingdom . | |
| 369478 | 3/1932 | United Kingdom . | |
| 664153 | 1/1952 | United Kingdom . | |
| 707620 | 4/1954 | United Kingdom . | |
| 865568 | 4/1961 | United Kingdom . | |
| 983480 | 2/1965 | United Kingdom . | |
| 1270992 | 4/1972 | United Kingdom . | |
| 2009330 | 6/1979 | United Kingdom . | |
| 2166202 | 4/1986 | United Kingdom . | |

OTHER PUBLICATIONS

Patent Abstracts of Japan, vol. 8, No. 96.

Patent Abstracts of Japan, vol. 13, No. 267.

*Primary Examiner*—Michael S. Huppert

*Assistant Examiner*—Virna Lissi Ansley

*Attorney, Agent, or Firm*—Bernard E. Shay; Jerome C. Squillaro

[57] ABSTRACT

A hollow core airfoil including a root adapted to attach the airfoil to a disk. An airfoil portion including a leading edge, a trailing edge, and a tip portion. The hollow core airfoil includes radial ribs extending from the root to the tip. Chord-wise stringers run from the leading edge to the trailing edge providing support along the chord-wise direction.

3 Claims, 2 Drawing Sheets

HOLLOW CORE AIRFOIL

This application is a continuation of application Ser. No. 07/685,946, filed Apr. 16, 1991 now abandoned.

FIELD OF THE INVENTION

The present invention is directed to a hollow core airfoil and, more particularly, to a hollow core airfoil including chord-wise stringers.

BACKGROUND OF INVENTION

Modern high bypass turbofan engines incorporate wide chord fan blades for improved aerodynamic efficiency. Hollow fan blade airfoils may be used to minimize system weight. Hollow airfoils may be manufactured by diffusion welding premachined airfoil sections together. A common internal core construction relies on the use of radial (or span-wise) ribs for centrifugal loading. These ribs support the airfoil skins against pressure differentials, bird impact, and running distortion. Radial ribs also provide stiffness for frequency tuning. That is, by adjusting the thickness, length and/or number of ribs, the resonant frequencies of the blade may be adjusted to acceptable values. Other characteristics of the radial ribs may also be adjusted to achieve desired airfoil characteristics.

Other designs also incorporate ribs aligned along the chord of the airfoil, substantially perpendicular to the radial ribs. This grid configuration is sometimes referred to as a "waffle" core. These ribs, while providing improved skin support and chord-wise stiffness, have their own drawbacks.

First, the diffusion bonds of the chord-wise ribs are aligned in a direction sensitive to centrifugal and flexural mode vibratory stresses. Diffusion bonds may exhibit local flaws or discontinuities (e.g. mismatched surfaces) which behave as cracks or stress concentrations. These defects effectively reduce the fatigue strength of the airfoil, and hence the life of the airfoil.

The chord-wise ribs also add significant weight to the airfoil itself. While chord-wise ribs provide skin support, much of the rib mass near the airfoil mean camber line supplies little or no additional stiffness. The additional "dead" or "parasitic" weight introduced by these ribs also lowers the flexural resonant frequencies of the airfoil.

Finally, it may be necessary to introduce gas to reinflate the "waffle" chambers after the two halves of the airfoil are diffusion bonded. The ribs of the "waffel" chamber, therefore, may incorporate access channels which can introduce stress concentrations beyond those introduced by the diffusion bond alone. In other words, by introducing discontinuities (e.g., step changes) in the rib, the access channels introduce changes in the stress concentrations at the edges of the access channels.

Chord-wise stiffeners have also been used on the outer surfaces of solid airfoils to provide increased resistance to bird impact. However, external stiffeners may degrade the aerodynamic properties of the airfoil.

SUMMARY OF THE INVENTION

A hollow core airfoil including a root adapted to attach the airfoil to a disk. An airfoil portion including a leading edge, a trailing edge, a tip portion and an outer skin. The hollow core airfoil includes radial ribs extending from the root to the tip. The radial ribs are continuous across the hollow space. A plurality of chord-wise stringers run from the leading edge to the trailing edge. The stringers lie along the airfoil skins and occupy a portion of the space between the inner and outer skins. The stringers on the inner and outer skins are not bonded to each other.

BRIEF DESCRIPTION OF THE DRAWINGS

The novel features of the invention are set forth with particularity in the appended claims. The invention itself, however, both as to organization and method of operation, together with further objects and advantages thereof, may best be understood by reference to the following description, taken in conjunction with the accompanying drawings in which:

DETAILED DESCRIPTION OF THE INVENTION

Figure 1:
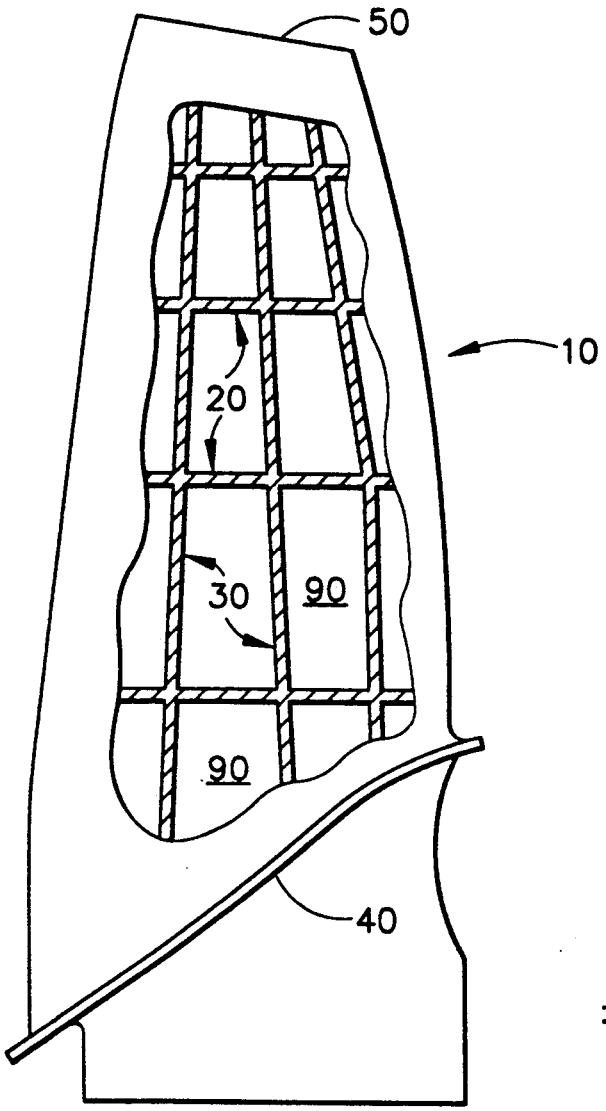
FIG. 1 (PRIOR ART)
FIG. 1 is a cut away drawing of a hollow core fan blade including "waffle" chambers.

FIG. 1 is a cut away view of a "waffle" core airfoil. Airfoil 10 may include a plurality of chord-wise ribs 20 and radial ribs 30. Radial ribs 30 may also be referred to as "span-wise" ribs. Radial ribs 30 extend from the root 40 to the tip 50 of blade 10.

Figure 2:
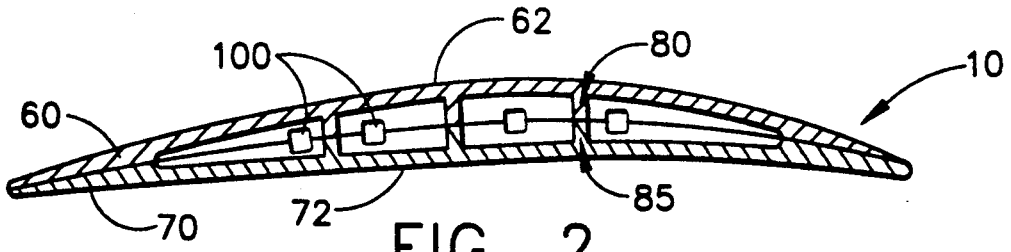
FIG. 2 (PRIOR ART)
FIG. 2 is a cut away edgewise view of the fan blade in FIG. 1.

FIG. 2 is a cut away view of the blade in FIG. 1. A plurality of ridges 80 and 85 are formed in each of first 60 and second 70 blade halves of airfoil 10 respectively. The hollow core fan blade is built by diffusion bonding first and second blade halves 60 and 70 together. Surfaces 62 and 72 comprise the external skin of the hollow cavity. When blade halves 60 and 70 are joined together by, for example, diffusion bonding, opposing ridges 80 and 85 are also bonded, creating a continuous rib 30. Chord-wise ribs may be formed by diffusion bonding preformed ridges to create an integrated "waffle" pattern. In the hollow airfoil illustrated in FIGS. 1 and 2, chord-wise ribs 20 are included for structural integrity. The diffusion bonded ribs in the waffle pattern create a rigid structure of isolated cavities 90. In order to access cavities 90, channels 100 (see FIG. 2) are formed in ribs 20 and 30. These access channels may be used, for example, to re-inflate the airfoil after diffusion bonding. By creating a rigid waffle structure, stress concentrations are created where cracks or discontinuities occur in the rib structure at the bond interface between chord-wise ribs. These stress concentrations are particularly disadvantageous in the chord-wise ribs because they experience the greatest radial steady state and vibratory forces. In addition, the addition of access channels 100 create greater stress concentrations at the diffusion bond interface.

Figure 3:
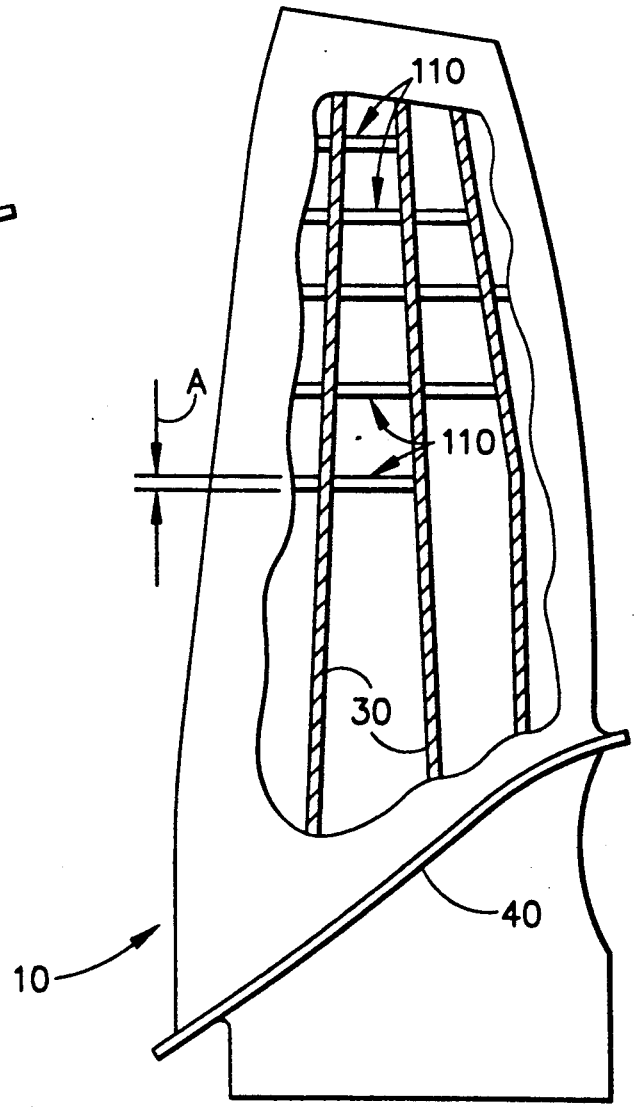
FIG. 3 is a cut away drawing of a hollow core fan blade according to the present invention.
Figure 4:
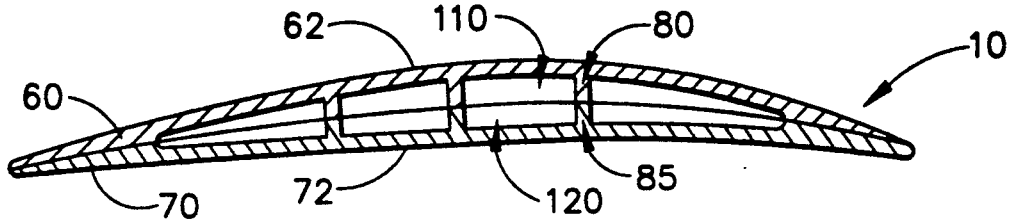
FIG. 4 is an edgewise cut away view of one embodiment of the present invention.

FIG. 3 illustrates an embodiment of the present invention. According to the present invention, chord-wise stringers 110 and 120 are included between radial ribs 30. Stringers 110 and 120 are formed in each of the first 60 and second 70 halves of airfoil 10 respectively. As FIG. 4 illustrates, stringers 110 and 120 may be as thick as ridges 80 and 85 if necessary. However, stringers 110 and 120 are not diffusion bonded, leaving them free to move relative to each other. If stringers 110 and 120 are thick enough to touch, a masking compound, such as Yttria (Y203) or any other suitable masking compound, may be used to prevent the surfaces from bonding when the airfoil halves 60 and 70 are diffusion bonded.

Figure 5:
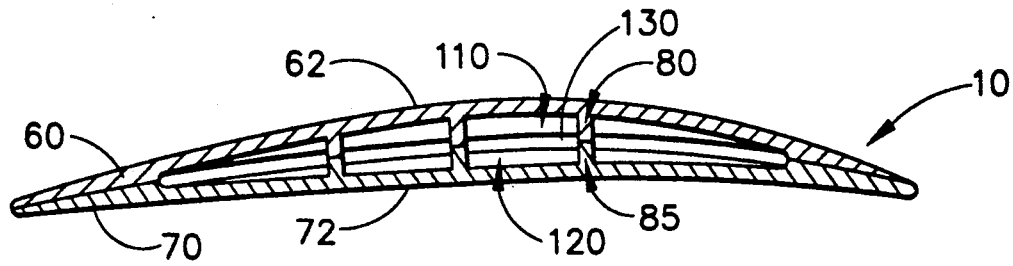
FIG. 5 is an edgewise cut away view of a second embodiment of the present invention.
Figure 6:
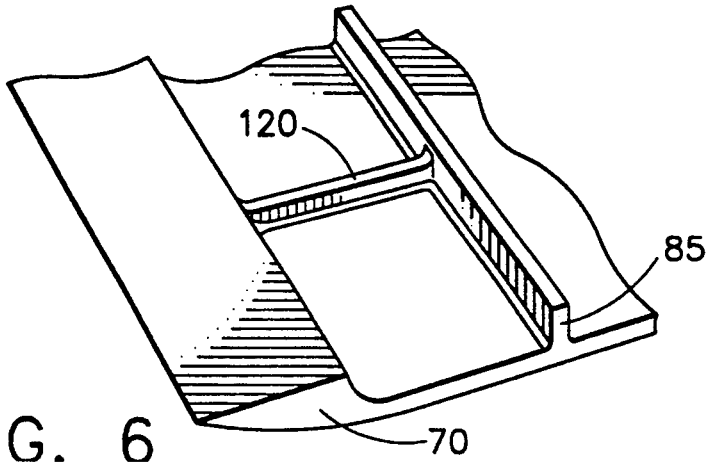
FIG. 6 is an expanded view of an internal portion of the embodiment of the present invention illustrated in FIG. 5.

As illustrated in FIGS. 5 and 6, the stringers may be formed to any convenient thickness. However, it is normally desirable to limit the thickness of stringers 110 and 120 to reduce the weight of the airfoil. Further, by using stringers which do not touch, a gap 130 is created between stringers 110 and 120, providing access to chambers 90. In addition, the stringer width (dimension A in FIG. 3) may be minimized without substantially reducing the structural advantages of including the stringers. The stringer is designed to provide support along the airfoil chord and perpendicular to the skin surface. Therefore, the stringer width is not a primary concern and may be a function of the manufacturing process. Further, as illustrated in FIG. 3, the stringers may be formed to any convenient length. The thickness and length of the stringers, as well as the position and number of stringers is a function of a number of variables each of which is unique to a particular airfoil design. Some of these variables include airfoil weight, resonant frequencies, load patterns (including bird strikes) and skin deflections.

According to the present invention, stringers 110 and 120 may be arranged such that the rib density (i.e. number of ribs per unit length) increases toward the airfoil tip. Stringers 110 may also be arranged in a "footprint" pattern as illustrated in FIG. 3, enabling the airfoil to absorb bird strikes without substantially increasing the airfoil weight. In the "footprint" pattern, the stringers are longest at the point where the probability of bird strike or foreign object damage is greatest and decrease in length and frequency in portions of the airfoil less susceptible to damage.

In addition, the length, thickness and width of stringers 110 and 120 may be used to tune the resonant frequency and oscillation modes of the airfoil. The specific length, thickness and widths of particular stringers is a function of that design criteria (e.g., resonant frequencies, bird strike capability).

FIG. 6 is a perspective view of the embodiment of the present invention illustrated in FIG. 5. A portion of second blade half 70 is illustrated in FIG. 6. Second blade half 70 includes ridge 85 which will be diffusion bonded to a ridge 80 to form a radial rib 30. Second blade half 70 also includes stringer 120 which is recessed from ridge 85.

The invention described involves the application of any number of stiffeners or stringers 110 and 120, aligned with the chord of the airfoil to the inside of hollow fan blades. Stringers offer maximum benefits in terms of increased chord-wise stiffness for both torsional frequency control and bird impact resistance, with a minimal impact on component weight and airfoil flexural stiffness.

FIG. 3 illustrates a layout of span-wise ribs and chord-wise stringers within the hollow cavity of a large wide chord fan blade. Any number, size, length or pattern of ribs and stringers can be used. The stringers could be concentrated in areas more susceptible to bird strike, such as near the outboard leading edge. They could also be placed strategically to influence torsional or stripe flex modes. Furthermore, stringers could be applied to one side of the airfoil in case extra local stiffness is needed to prevent buckling or collapse during bird impact or foreign object impact.

According to the present invention, stringers on mating airfoil halves do not come into contact, therefore, no bonding is involved, and no stress concentrations are created that are sensitive to centrifugal stresses or flexural modes. Also, as each cavity remains connected with others along the radial direction, each is open to tip or root access. Finally, since material near the flexural center of the airfoil has negligible effect on chord-wise stiffness, it may be omitted, thereby reducing weight, and minimizing the reductions in flexural frequency.

Stringers could be machined by any number of conventional or other methods. Transition radii between the stringers and skin could be designed to have little effect in concentrating local radial stresses. The stringers in each rib cavity may be aligned or staggered, and because opposing stringers are not in contact (bonded), dimensional control (alignment) is much less critical.

A hollow core airfoil according to the present invention provide maximum chord-wise airfoil stiffness for bird impact and torsional frequency tuning. Internal stringers do not reduce air flow or fan performance. Further, the advantages are provided with minimum increases in component (and system) weight. In addition, the present invention reduces or eliminates stress raisers in an orientation sensitive to the stress field. In addition, the present invention can be used to alter complex (chord-wise bending) frequencies to avoid resonance.

While preferred embodiments of the present invention have been shown and described herein, it will be obvious to those skilled in the art that such embodiments are provided by way of example only. Numerous variations, changes, and substitutions will now occur to those skilled in the art without departing from the invention. Accordingly, it is intended that the invention be limited only by the spirit and scope of the appended claims.

What we claim is:

1. A hollow core airfoil comprising:

first and second halves diffusion bonded together;

a substantially hollow central portion between said first and second halves;

a root portion, a tip portion, a leading edge and a trailing edge;

a plurality of radial ribs extending from said root portion to said tip portion within said hollow portion wherein said radial ribs comprise ridges of said first and second half diffusion bonded to form continuous ribs; and a plurality of chord-wise stringers within said hollow portion wherein said stringers are arranged such that said stringers on said first half are not bonded to said stringers on said second half and a portion of said chord-wise stringers extend from said leading edge to said trailing edge wherein said chord-wise stringers are arranged in a foot print pattern starting at said leading edge and having a length proportional to a predetermined load concentration at said leading edge.

2. A hollow core airfoil according to claim 1 wherein said predetermined load concentration corresponds to a probability of foreign object damage in said airfoil.

3. A hollow core airfoil comprising;

an outer skin surrounding said hollow core;
a root, a tip, a leading edge and a trailing edge;
a plurality of radial ribs in said hollow core; and
a plurality of chord-wise stringers arranged substantially perpendicular to said radial ribs in said hollow core wherein said stringers comprise raised portions of said outer skin which are not bonded within said hollow core and wherein said chord-wise stringers increase in frequency from said root to said tip.

* * * * *